United States Patent [19]

Langen et al.

[11] Patent Number: 5,052,546

[45] Date of Patent: Oct. 1, 1991

[54] CONVEYOR HAVING A CIRCULATING ARTICLE CARRIER ELEMENT

[75] Inventors: Manfred Langen; Gregor Gebald, both of Mönchen-Gladbach, Fed. Rep. of Germany

[73] Assignee: Trüzschler GmbH & Co. KG, Mönchen-Gladbach, Fed. Rep. of Germany

[21] Appl. No.: 182,712

[22] Filed: Apr. 18, 1988

[30] Foreign Application Priority Data

Apr. 18, 1987 [DE] Fed. Rep. of Germany ..... 3713264

[51] Int. Cl.[5] ..... B65G 19/00

[52] U.S. Cl. ..... 198/718; 198/721; 198/732

[58] Field of Search ..... 198/718, 721, 732

[56] References Cited

U.S. PATENT DOCUMENTS

| | | | |
|---|---|---|---|
| 3,799,327 | 3/1974 | Schulz | 198/718 |
| 3,994,629 | 7/1975 | Wakabayashi | 198/718 |
| 4,658,951 | 4/1987 | Saunders | 198/718 |

FOREIGN PATENT DOCUMENTS

| | | | |
|---|---|---|---|
| 82926 | 7/1983 | European Pat. Off. . | |
| 1510356 | 5/1970 | Fed. Rep. of Germany . | |
| 1964857 | 7/1971 | Fed. Rep. of Germany . | |
| 2413040 | 10/1975 | Fed. Rep. of Germany | 198/732 |
| 2418249 | 10/1975 | Fed. Rep. of Germany | 198/732 |
| 83724 | 8/1971 | German Democratic Rep. . | |
| 6602114 | 9/1966 | Netherlands | 198/732 |
| 8400143 | 1/1984 | World Int. Prop. O. | 198/732 |

*Primary Examiner*—Joseph E. Valenza

*Attorney, Agent, or Firm*—Spencer & Frank

[57] ABSTRACT

A conveyor apparatus for advancing articles in a direction of conveyance, including a conveyor track on which the articles are supported; an endless driven conveyor element and an article carrier device including an article carrier element pivotally supported on the endless driven conveyor element. The article carrier element is adapted to engage and thus convey, or be disengaged from an article on the conveyor track. The article carrier element comprises a pivotal lever and a carrier lug formed on the pivotal lever. The latter has an activated pivotal position in which the carrier lug is adapted to be brought into and maintained in a force-transmitting engagement with one of the articles and a deactivated pivotal position in which the carrier lug is maintained disengaged from the articles. A force-exerting device urges the pivotal lever into the activated position. There is further provided a contact element on the pivotal lever downstream of the carrier lug as viewed in the direction of conveyance. The contact element is arranged for being depressed by a downstream situated object for causing a rotation of the pivotal lever into the deactivated position.

8 Claims, 3 Drawing Sheets

CONVEYOR HAVING A CIRCULATING ARTICLE CARRIER ELEMENT

BACKGROUND OF THE INVENTION

This invention relates to a conveyor apparatus for advancing relatively large articles such as coiler cans which are cylindrical containers for accommodating coiled sliver therein, produced by a carding machine or the like. The conveyor apparatus is of the type which has a stationary conveyor track, such as a roller track on which the articles are supported and an endless article advancing mechanism, such as a conveyor chain on which pivotal article carrier devices (carrier elements) are mounted. Each carrier element is arranged for assuming a latching position in which it engages into a recess provided at the bottom edge of the article and is thus exerting the conveying force to move the article on and with respect to the conveyor track in the conveying direction.

German Offenlegungsschrift (non-examined published patent application) 1,510,356 discloses a coiler can conveyor apparatus which comprises an endless conveyor chain on which article carriers are pivotally mounted. Each article carrier is drawn onto a stationary cam plate and is, as a result, pivoted upwardly whereby it engages into the lower edge of the coiler can. Thereafter, the coiler can is dragged along by the article carrier until the latter, after having reached the end of the cam plate, pivots away and thus disengages from the can, causing stoppage thereof. The coiler cans have an outer circumferential edge provided at their bottom. Thus, the pivotal article carriers are positively and permanently maintained in their upward pivoted, article-engaging position by the cam plate along a conveying path of predetermined length. This type of conveyor apparatus exerts a conveying force on the coiler cans along the entire length of the conveyor. Such a known conveyor apparatus is therefore not capable of accumulating the cans on the conveyor track without discontinuing a forward pressure thereon and likewise cannot separate the cans particularly because an article carrier is provided which is, by means of the cam plate, continuously pressed upwardly along the entire conveyor track and therefore engages the can at the beginning of the track and releases it only at the end thereof after the carrier element drops down as it reaches the downstream end of the cam plate. An accumulation of the coiler cans may occur only on a downstream-arranged receiving platform. The accumulating process involves, however, a forwardly oriented pressure, because each time the momentarily trailing can is still positively conveyed and thus pushes forwardly the can in front of it. Since the conveyor system terminates with the receiving platform, a separation of cans cannot be effected subsequently.

SUMMARY OF THE INVENTION

It is an object of the invention to provide an improved conveyor apparatus of the above-outlined type from which the discussed disadvantages are eliminated and which, in particular, permits a pressureless accumulation and a separation of the conveyed articles.

This object and others to become apparent as the specification progresses, are accomplished by the invention, according to which, briefly stated, the pivotal article carrier is a biased lever which has, as viewed in the conveying direction, a carrier lug for engaging the article to be conveyed and a contact element which is situated downstream of the carrier lug as viewed in the conveying direction and which is depressible by a downstream located object, such as another article on the conveyor track or a hold-down device.

By virtue of the invention, there may be advantageously achieved a pressureless accumulation and a separation of the articles conveyed.

Additional advantageous features of the invention are as follows:

- the contact element is a roller;
- the contact element comprises a sliding member;
- the upper boundary of the contact element (roller or slide element) is situated at a higher height level than the carrier lug;
- the article carrier is a two-arm lever pivotal about a generally horizontal axis and having a force arm and a working arm. The force arm is biased by a downwardly effective force exerting element which may be a spring. The carrier lug and the roller are mounted on the output (working) arm of the two-arm lever;
- the carrier device comprises a single-arm lever which is pivotal about a generally horizontal axis and which is biased by a force exerting element having an upward force component;
- the recess of the coiler can into which the carrier lug latches is a circular groove provided in the bottom face of the can;
- the pivotal article carrier is connected with an actuating device which controls the latching and unlatching movement of the carrier element.

Thus, according to a preferred embodiment the coiler cans have a circumferential groove in the outer face of their bottom and the pivotal carrier is urged by spring force or by a counterweight upwardly. The contact element (contact roller) of the pivotal article carrier is, by means of a downstream-adjoining article, or an unlatching device (hold-down device) or a closure plate forced downwardly against a spring force and thereby the pivotal carrier is moved out of the bottom groove of the can it has advanced by virtue of the engagement. In this manner, a plurality of coiler cans may be accumulated behind one another on the carrier track without a forward force (conveying force) pushing against the cans. The leading can is, if needed, further conveyed from the accumulated cans as an article carrier arrives in a force-transmitting engagement therewith. In this manner a separation of the accumulated coiler cans is possible with the same type of conveyor system. A further advancement of the coiler cans may be prevented by the actuation of a disengaging device, a receiving platform or the like. The chain is preferably horizontally deflected so that the return flight of the chain simultaneously may be used as a conveying track, accumulating track or separating track operating in a backward (return) direction. In practice, one conveyor track may handle coiler cans filled with fiber material (sliver) while the return track may be used to convey empty cans. A desired number of disengaging devices causing the article carrier to pivot into its releasing position may be used within the conveyor system. The system also permits a conveyance of articles other than in a straight line. Because of the horizontal deflection of the conveyor chain the structural height of the conveyor apparatus is advantageously particularly low. It is to be understood, however, that the endless conveyor chain may be supported at its end such that a deflection of the chain is effected in a vertical plane.

In contradistinction to the known transporting tracks in which the articles are positively conveyed from the beginning of the predetermined conveyor track to the end thereof, the conveyor apparatus according to the invention serves as a conveyor and accumulating track as well as a separating track for the separation of the accumulated cans for a further forward and/or return transport thereof.

Contrary to an external circumferential groove provided in the coiler cans for receiving the pivotal article carrier element of the conveyor chain in conventional conveyors, the circumferential groove provided in the bottom face of each coiler can is significant particularly in view of the configuration of the pivotal article carrier device provide with a contact roller. If an external groove were present in the coiler cans according to prior art constructions, the carrier would latch into the external edge at the trailing side because the contact roller finds no resistance by the can bottom and is therefore pressed upwardly into an activated position. By providing a bottom groove according to the invention, the contact roller, after it has passed the groove, is again pressed downwardly into a deactivated position and the carrier cannot engage into the bottom groove. The contact roller rolls on the can bottom and also rolls over the frontal zone of the groove, including the adjoining edge and may pivot upwardly and establish operative, force-transmitting engagement with the coiler can situated immediately above the carrier device only if in the further course of its travel there is no can present. The can is carried until another can is met which is situated in front in the conveying direction which triggers a disengagement of the carrier via the contact roller or by means of a hold-down device which actuates the contact roller and thus causes an unlatching of the article carrier arm.

The separation of the cans is carried out in a positive manner since the carrier devices can advance cans only as defined by the spacing between the carrier devices. If the space between consecutive carrier arms is greater than the diameter of the coiler cans, the latter will be conveyed with spaces therebetween. By means of a device at any desired location, the contact roller may be pressed downwardly and thus cause stoppage of the transported can. Subsequently advanced cans then run onto the stationary can ahead of them and are themselves disengaged and therefore produce an accumulation which is void of any forwardly directed propelling force transmitted from the conveyor. If the carrier disengaging device is deactivated, the contact roller of the subsequent carrier device is once again freed, whereupon that carrier engages the leading can and moves it away. The subsequent carriers then engage the subsequent second, third, etc. can whereby all the accumulated cans are gradually separated from one another.

DESCRIPTION OF THE PREFERRED EMBODIMENTS

Figure 1A:
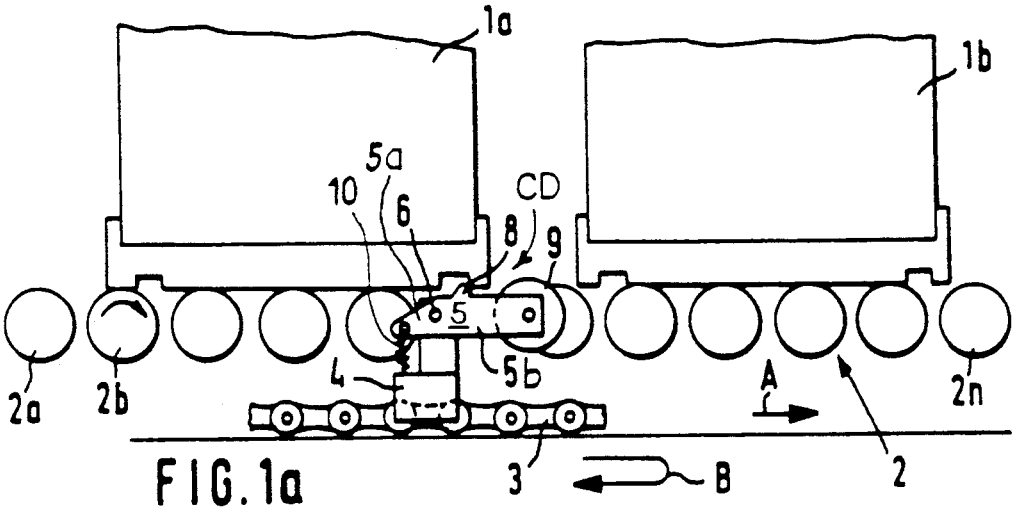
FIG. 1*a* is a schematic side elevational view of a preferred embodiment of the invention shown in an engaged position.
Figure 1B:
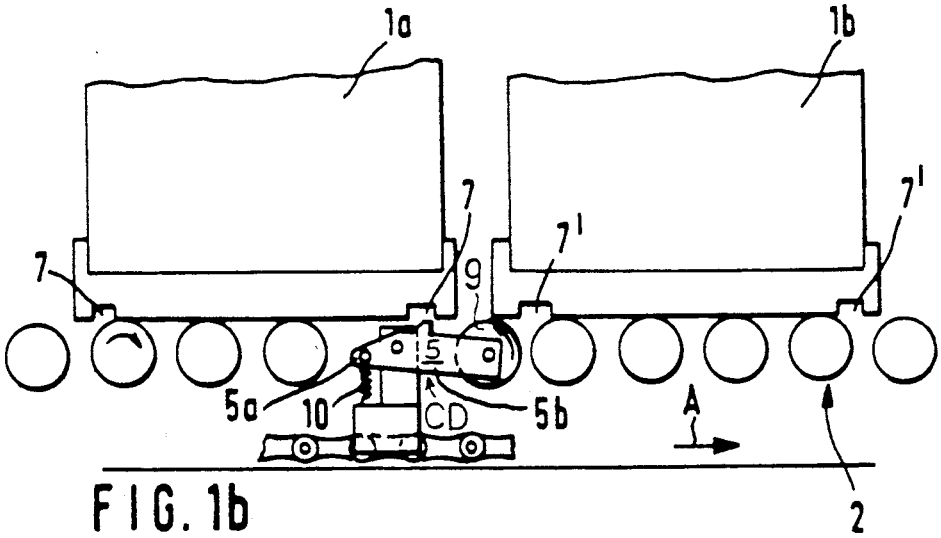
FIG. 1*b* is a view similar to FIG. 1*a* illustrating the structure in a disengaged position.

Turning to FIGS. 1*a* and 1*b*, coiler cans 1*a* and 1*b* are positioned on a conveyor track 2 formed of stationarily supported rollers 2*a*, 2*b*, 2*n* for displacement thereon in the direction of the arrow A. The apparatus for effecting conveyance of the cans comprises an endless conveyor chain 3 which is supported by non-illustrated end sprockets and which is connected to a power device to effect travel thereof in the direction of the arrow A. To the chain 3 there is secured an article carrier device CD structured according to the invention. Several article carrier devices CD may be mounted on chain 3 at predetermined distances. The carrier device CD comprises a support bracket 4 affixed to the chain 3 as well as a carrier arm 5 pivotally secured to the bracket 4 by means of a generally horizontal pivot 6. The pivot 6 divides the carrier lever 5 into two arms 5*a* and 5*b*. The carrier arm 5*a* is exposed to the downwardly directed force of a tension spring 10 supported on the bracket 4. At its upper edge the lever arm 5*b* is provided with a carrier lug 8 which, as will be described later, is adapted to project into a recess, constituted by a circumferential groove 7 in the can, for force-transmittingly engaging a vertical groove wall of the can. The outer end of the lever arm 5*b* carries a contact roller 9 rotatable about a horizontal axis. FIG. 1*a* illustrates the pivotal carrier arm 5 in an engaged state in which the carrier lug 8 projects into the groove 7 of the coiler can 1*a*. In FIG. 1*b* the carrier arm 5 is shown in a disengaged position in which the lug 8 is spaced from the can groove 7, and the roller 9 is in contact with and is pressed downwardly by the bottom face of the coiler can 16.

Figure 2:
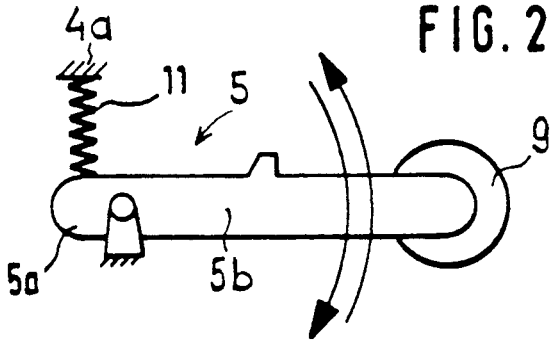
FIG. 2 is a schematic side elevational view of another preferred embodiment of the invention.

In the embodiment according to FIG. 2, the force-exerting member is a compression spring 11 which engages the lever arm 5*a* from the top and is secured, for example, to an overhanging component 4*a* of the bracket 4.

Figure 3:
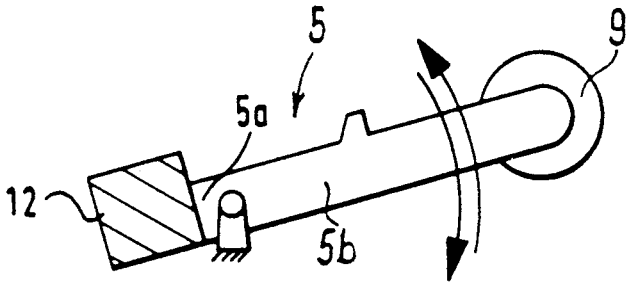
FIG. 3 is a schematic side elevational view of another preferred embodiment of the invention.

According to the embodiment shown in FIG. 3, the lever arm 5*a* of the pivotal carrier lever 5 is provided with a weight 12 which exerts a downward force on the lever arm 5*a* by gravity.

Figure 4A:
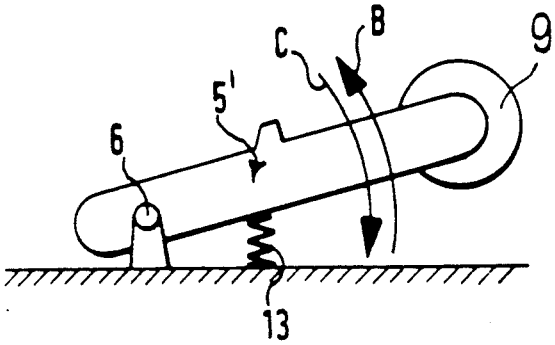
FIG. 4*a* is a schematic side elevational view of another preferred embodiment of the invention.
Figure 4B:
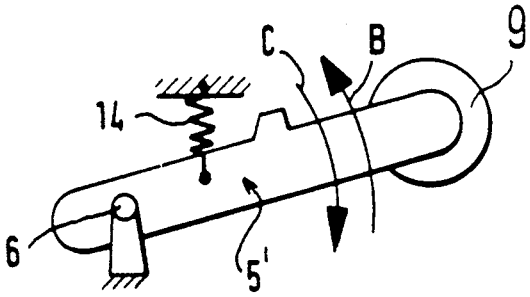
FIG. 4*b* is a schematic side elevational view of a further preferred embodiment of the invention.

According to the embodiments illustrated in FIGS. 4*a* and 4*b*, the pivotal carrier lever 5' is a one-arm lever connected to an upwardly acting compression spring 13 (FIG. 4*a*) or an upwardly acting tension spring 14 (FIG. 4*b*). In FIGS. 4*a* and 4*b* the pivotal motion of the lever 5' in response to the spring force is illustrated with the arrow B while the pivotal motion of the lever 5' caused, for example, by the bottom of a coiler can pressing down on the roller 9 is designated at C.

Figure 5:
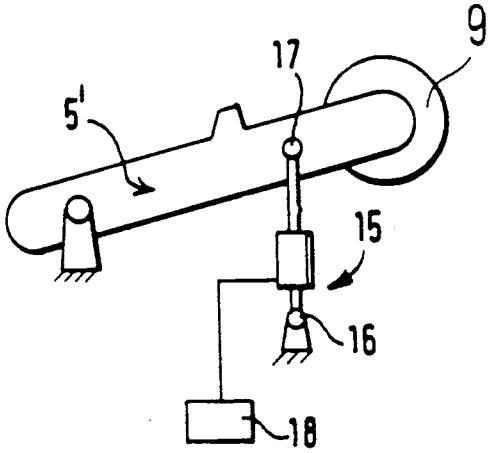
FIG. 5 is a schematic side elevational view of yet another preferred embodiment of the invention.

Turning to the embodiment illustrated in FIG. 5, an actuating device, such as a pneumatic cylinder unit (power unit) 15 is connected to the carrier lever 5' at one end and mounted at a support 16 (forming part, for example, of the support bracket 4) at the other end. The power unit 15 is connected to an electric control device 18 which actuates the power device 15 to cause an engagement or disengagement of the pivotal carrier lever with an article. In this manner, the conveyance of the articles, their pressureless accumulation and a separation from an accumulated state may be controlled in a programmed manner.

Figure 6A:
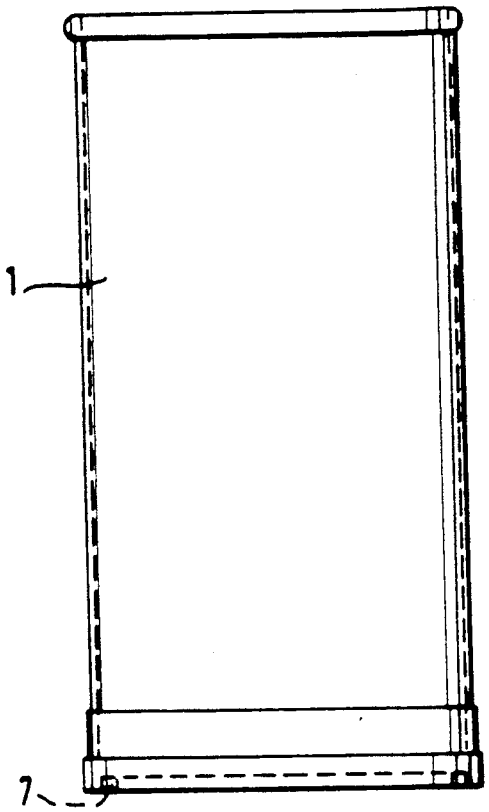
FIGS. 6*a* and 6*b* are side elevational and bottom plan views, respectively, of an article to be handled by the apparatus according to the invention.
Figure 6B:
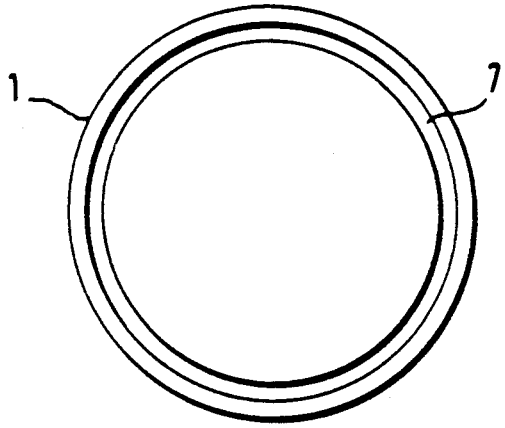

FIGS. 6*a* and 6*b* show the circumferential bottom groove 7 which is provided in the underside of the bottom of the cylindrical coiler can 1 and which is concentric thereto.

In the description which follows, the operation of the invention will be described with particular reference to FIGS. 1*a* and 1*b*.

It is assumed that initially a coiler can 1*a* is supported stationarily on the roller track 2 and, as the chain 3 moves in the direction of arrow A, a carrier device CD approaches the coiler can 1*a* from the left.

As the roller 9 of the carrier device CD arrives into contact with the trailing bottom edge of the coiler can 1*a*, the pivotal carrier lever 5 is forced to rotate clockwise about the pivot 6 against the force of the downwardly acting spring 10 into a deactivated position and is maintained in that position while the roller 9 rolls along the bottom face of the coiler can 1*a*. Since the upper boundary of the roller 9 is at a higher level than the lug 8, the latter will remain out of contact with the trailing zone of the groove 7 of the coiler can 1*a*.

As the roller 9 has reached the right-hand edge of the coiler can 1*a*, the roller 9 will no longer be pressed downwardly and thus the spring 10 causes a counterclockwise pivotal motion of the carrier lever 5 into the activated position. The distance between the lug 8 and the roller 9 as well as the distance of the groove 7 from the outer edge of the bottom are so designed that as such a counterclockwise pivotal movement of the carrier lever 5 occurs, the lug is in alignment with (or has not yet passed) the leading region of the groove 7 so that, as a result, the pivotal carrier lever assumes its engaged position in which the lug 8 projects into the groove 7 and thus a conveying force from the chain 3 is exerted on the coiler can 1*a* by virtue of the engagement between the carrier lug 8 and the vertical wall of the groove 7. Such an engagement thus causes conveyance of the can 1*a* to the end of the conveyor track or as long as the pivotal carrier lever 5 is allowed to remain in its engaged position.

If, during its forward travel, the coiler can 1*a* encounters a downstream-situated, stationary coiler can 1*b*, the contact roller 9 of the pivotal carrier lever 5 which advances the coiler can 1*a* will engage the bottom face of the coiler can 1*b* whereupon the pivotal carrier lever 5 will move clockwise, thus disengaging from the groove 7 of the coiler can 1*a*, as illustrated in FIG. 1*b*. This causes a stoppage of the coiler can 1*a* immediately adjoining the coiler can 1*b*: in this manner, an accumulation of coiler cans may be achieved with an automatic removal of the conveying force, triggered by an immediately downstream-situated coiler can. The pivotal carrier lever 5 which was originally in engagement with the groove 7 of the coiler can 1*a* now travels, in a clockwise pivoted, deactivated position, underneath the coiler can 1*b* and continues such a travel underneath any other subsequent coiler cans.

It will be apparent from the above operational description that a sequential separation of accumulated coiler cans may be achieved by the same type of carrier mechanism which will engage a leading coiler can of the accumulated can assembly, that is, the forwardmost can since then the roller 9 will find no resistance (downwardly pressing force) as it moves out from below the forwardmost can and therefore the pivotal carrier lever may pivot counterclockwise into its activated position to engage such forwardmost coiler can. Such a separation procedure would then progress sequentially until all the accumulated coiler cans are separated.

The present disclosure relates to subject matter contained in Federal Republic of Germany Patent Application No. P 37 13 264.4 (filed Apr. 18th, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a conveyor apparatus for advancing articles in a direction of conveyance, including a conveyor track on which the articles are supported and relative to which the articles may travel in the direction of conveyance; an endless driven conveyor element extending adjacent the conveyor track parallel to said direction of conveyance; and an article carrier device including an article carrier element pivotally supported on and advanced by said endless driven conveyor element in said direction of conveyance; said article carrier element being arranged for engaging an article situated on said conveyor track and advancing the article in the direction of conveyance by transmitting thereto a propelling force derived from the travel of said endless driven conveyor element, said article carrier element being further arranged for being disengaged from the article; the improvement comprising the combination of the apparatus with generally cylindrical sliver coiler cans constituting said articles; each said cylindrical sliver coiler can having a bottom face provided with a circumferential groove; further wherein said article carrier element comprises a pivotal lever, a carrier lug formed on said pivotal lever and projecting therefrom; said pivotal lever having an activated pivotal position in which said carrier lug is adapted to be brought into and maintained in a force-transmitting engagement with one of the cans; said carrier lug being arranged for projecting into said groove in the activated position of said pivotal lever; said pivotal lever having a deactivated pivotal position in which said carrier lug is maintained disengaged from the cans; force-exerting means for urging said pivotal lever into said activated position; and a contact element mounted on said pivotal lever downstream of said carrier lug as viewed in said direction of conveyance; said contact element being arranged for being depressed by the bottom face of another of said cans situated downstream of said one can for causing a rotation of said pivotal lever into said deactivated position.

2. A combination as defined in claim 1, wherein said contact element comprises a roller.

3. A combination as defined in claim 1, wherein said contact element has a location of contact where said contact element is depressed; said location projecting farther from said lever than said carrier lug.

4. A combination as defined in claim 1, wherein said pivotal lever has first and second arms; said force-exerting means being in engagement with said first arm.

5. A combination as defined in claim 4, wherein said carrier lug and said contact element are arranged on said second arm.

6. A combination as defined in claim 1, wherein said force-exerting means comprises a biased spring.

7. A combination as defined in claim 1, wherein said pivotal lever has a single arm engaged by said force-exerting means and accommodating said carrier lug and said contact element.

8. A combination as defined in claim 1, further comprising a control means, including an actuating means carried by said endless driven conveyor element for moving said pivotal arm into one of said positions independently from depressing and releasing said contact element.

* * * * *